US005540565A

United States Patent [19]

Bearint

[11] Patent Number: 5,540,565

[45] Date of Patent: Jul. 30, 1996

[54] VARIABLE CAPACITY VANE COMPRESSOR WITH LINEAR ACTUATOR

[75] Inventor: David E. Bearint, Decatur, Ill.

[73] Assignee: Zexel USA Corporation, Decatur, Ill.

[21] Appl. No.: 529,875

[22] Filed: Sep. 18, 1995

[51] Int. Cl.[6] ..... F04B 49/00

[52] U.S. Cl. ..... 417/295; 251/284

[58] Field of Search ..... 417/295, 310; 251/58, 284

[56] References Cited

U.S. PATENT DOCUMENTS 5,141,418 8/1992 Ohtaki et al. .
5,145,327 9/1992 Nakajima et al. ..... 417/310
5,199,855 4/1993 Nakajima et al. ..... 417/310
5,364,235 11/1994 Bearint ..... 417/295

FOREIGN PATENT DOCUMENTS 2259294 10/1990 Japan ..... 417/295

*Primary Examiner*—Charles G. Freay
*Attorney, Agent, or Firm*—James E. Bradley

[57] ABSTRACT

A variable capacity vane compressor uses a linear actuator. The linear actuator is pivotally connected to a valve plate to rotate the valve plate between minimum delivery and maximum delivery positions. The actuator has springs on each end which bias the actuator to an equilibrium position between the full and minimum delivery positions for start up. Control pressure is supplied to one side of the actuator while the other side of the actuator is at intake pressure.

16 Claims, 3 Drawing Sheets

VARIABLE CAPACITY VANE COMPRESSOR WITH LINEAR ACTUATOR

BACKGROUND OF THE INVENTION

1. Field of the Invention

This invention relates in general to variable capacity vane compressors for air conditioning systems, particularly for vehicles.

2. Description of the Prior Art

One type of automotive air conditioning compressor in use is a variable capacity vane compressor. In this type of compressor, a compression housing has a chamber that is oval in shape. A cylindrical rotor rotates within the chamber. The rotor has radial vanes mounted to it which slide in slots formed in the rotor. Refrigerant at suction pressure enters the compression chamber. The vanes compress the refrigerant, which passes outward through a valve.

The compressor demand varies according to speed and atmospheric conditions. At highway speed, the demand is usually lower than while idling on a hot day. To vary the capacity, a rotary valve disk or plate mounts in engagement with a shoulder on the compression housing. The valve plate has lobes on its perimeter which will change the position of the opening from the suction chamber into the compression chamber, depending upon the rotational position of the valve plate.

U.S. Pat. No. 5,364,235 shows a linearly moving actuator which will rotate the valve plate to selected positions depending upon changes in the discharge and intake pressures. A control valve supplies a control pressure to one side of the actuator, and the other side of the actuator is at intake pressure. The control valve operates in response to varying intake and discharge pressures.

The linear actuator has a spring which urges the actuator away from the intake side toward the control pressure side. The spring will position the actuator in the minimum delivery position when the compressor is not operating. Tests have shown that pressure surges sometimes occur, causing the actuator to move rapidly from the minimum delivery to the maximum delivery position. This rapid shift in position has disadvantages.

U.S. Pat. No. 5,364,235 also discloses a pressure chamber for applying an axial force on a rotary valve plate that is proportional to the control pressure. The annular pressure chamber is located in a recess that contains a seal. The seal applies a force to a bearing pack which in turns engages the valve plate. In the '235 patent, the bearing pack components are located partially within a recess in the valve plate, and partially within a portion of the valve housing. While workable for applying the desired pressure to the valve plate, this arrangement results in assembly difficulties.

SUMMARY OF THE INVENTION

In this invention, the linear actuator utilizes two springs. The second spring is located on the control pressure side of the actuator. It urges the actuator member toward the suction side, while the suction pressure side spring urges the actuator toward the control side. The two springs are arranged so that equilibrium is reached with the actuator in an intermediate position between the full delivery and minimum delivery positions while the compressor is off.

Preferably, the control pressure side spring has its outer end positioned so that it will contact a stop and apply a force only when during or near the minimum delivery position.

The control side spring does not have any effect once the actuator is past the selected intermediate position and closer to the maximum delivery position.

The thrust bearing pack for applying axial thrust to the valve plate is located entirely within the same recess which contains the seal for delivering the control pressure. The face of the thrust bearing is flush with the support face of the valve housing. The valve plate has a smooth, flat face extending from a central counterbore to the outer diameter of the thrust bearing.

DETAILED DESCRIPTION OF THE INVENTION

Figure 1:
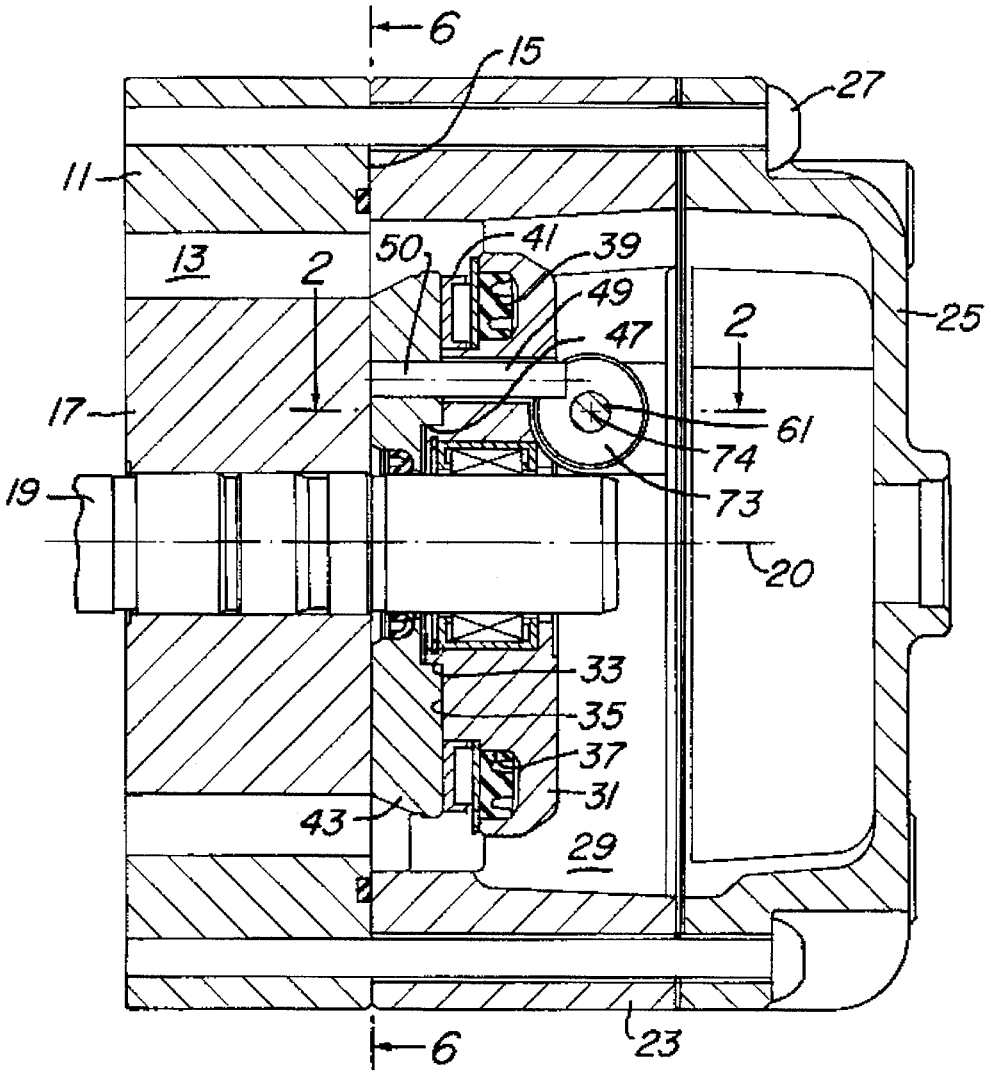
FIG. 1 is a partial sectional view illustrating a compressor constructed in accordance with this invention.
Figure 6:
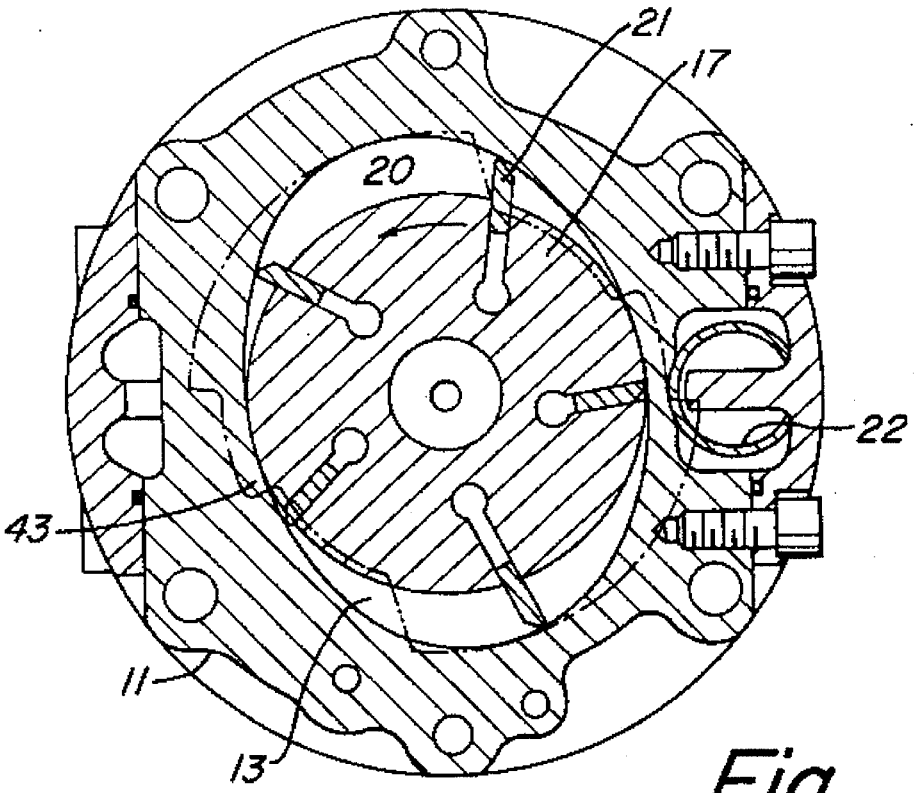
FIG. 6 is a sectional view of the compressor of FIG. 1, taken along the line of 6—6 of FIG. 1.

Referring to FIG. 1, the compressor has a compression housing 11. Compression housing 11 has a compression chamber 13 which is oval in shape, as shown in FIG. 6. A shoulder 15 faces in a rearward direction, with "rearward" being an arbitrary reference. Rotor 17 has a cylindrical configuration, as shown in FIG. 6, and is rotated within compression chamber 13 on a rotational axis 20. Shaft 19 drives rotor 17 and is connected to a drive source (not shown).

Referring still to FIG. 6, a plurality of vanes 21 extend outward from slots within rotor 17. Vanes 21 engage the sidewall of compression chamber 13 to compress refrigerant as rotor 17 rotates. A discharge valve 22 allows the discharge of refrigerant from compression chamber 13 into a discharge chamber (not shown) located on the opposite end.

Referring again to FIG. 1, valve housing 23, also called a rear side block, abuts compression chamber shoulder 15. A rear head 25 is secured to the opposite side of valve housing 23. Bolts 27 secure rear head 25 and valve housing 23 to compression housing 11. An intake or suction chamber 29 is located within rear head 25 and valve housing 23.

Valve housing 23 has a central portion 31 which is surrounded by passages leading from intake chamber 29 to compression chamber 13. Central portion 31 is located on the longitudinal axis 20 of shaft 19. A circular boss 33 surrounds a hole extending through central portion 31, which receives shaft 19. A face 35 extends radially from boss 33.

A recess 37 is formed at the outer perimeter of face 35. Recess 37 is located close to the periphery of central portion 31. Recess 37 is annular and rectangular in transverse cross-section. A seal 39, either a spring actuated lip type, or elastomeric type, is located in recess 37. A bearing pack 41 is located in engagement with seal 39. Bearing pack 41 is a roller type bearing having a front thrust washer, a rear thrust washer and caged rollers located between. The rear thrust washer is in contact with seal 39. The front thrust washer bears against the rear face of valve plate 43. The inner diameter of the assembled bearing pack 41 is closely received on a cylindrical inner wall of recess 37.

Figure 7:
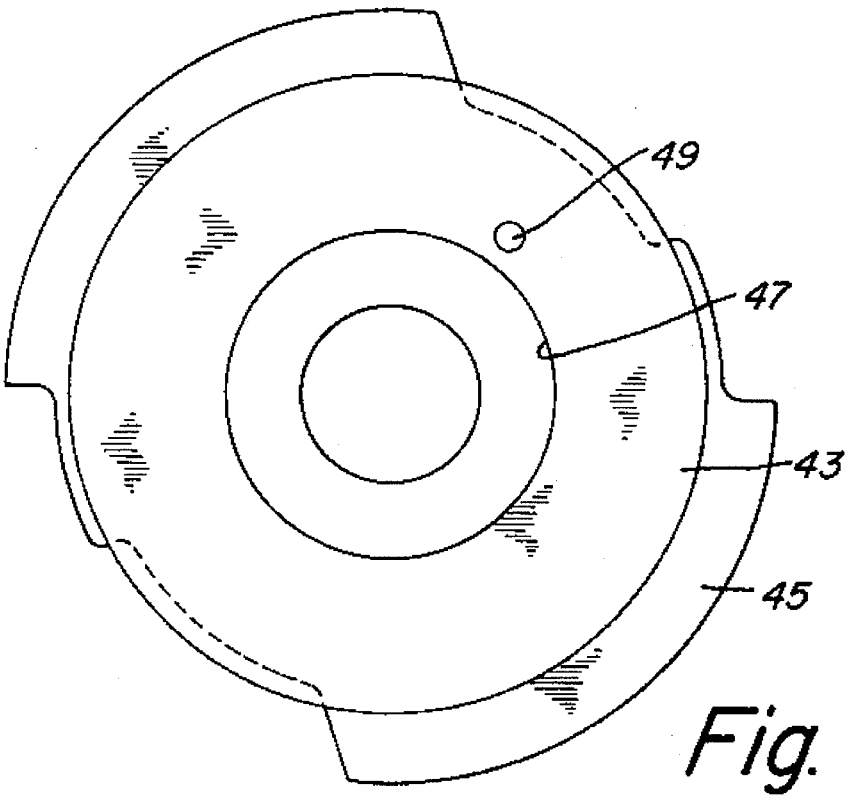
FIG. 7 is a rear elevational view of the rotary valve plate used with the compressor of FIG. 1.

A valve plate 43 is sandwiched between compression chamber shoulder 15 and face 35. Valve plate 43 is fitted with a central seal which rotatably receives shaft 19. Valve plate 43 is a generally flat disk having a pair of peripheral lobes 45, shown in FIG. 7. Referring again to FIG. 1, a counterbore 47 is formed in valve plate 43 for closely receiving boss 33. The rearward face of valve plate 43 from counterbore 47 to the periphery is a flat surface perpendicular to the longitudinal axis of shaft 19. A cylindrical steel pin 49 is rigidly secured to valve plate 43 and extends in a rearward direction on a pin axis 50 which is parallel to and offset from the longitudinal axis of shaft 19. Pin 49 is used to rotate valve plate 43 between minimum delivery and maximum delivery positions.

Figure 2:
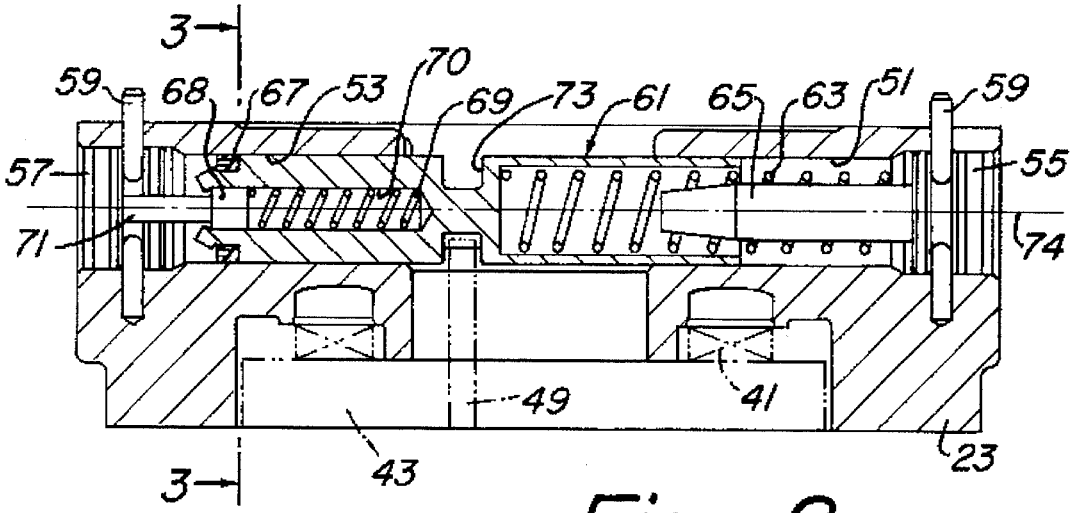
FIG. 2 is another sectional view of the compressor of FIG. 1, taken along the section line 2—2 of FIG. 1.

Referring to FIG. 2, an intake pressure bore 51 and a control pressure bore 53 are formed in valve housing 23 perpendicular to longitudinal axis 20. Bores 51, 53 are co-axial and of the same diameter in the preferred embodiment. Bores 51, 53 are separated by a portion of intake chamber 29. Intake pressure bore 51 is closed on its outer end by an end cap 55. An end cap 57 closes the outer end of control pressure bore 53. Pins 59 are used to secure end caps 55, 57 to valve housing 23.

An actuator member 61 is reciprocally carried in bores 51, 53. Actuator member 61 is a linearly moving piston. An intake side spring 63 locates within a recess formed in actuator 61. Intake side spring 63 has one end that continually engages end cap 55. Intake side spring 63 is continually under some compression, urging actuator 61 to the left, which is the minimum delivery position of valve plate 43. An intake side stop 65 provides a limit to the travel of actuator 61 to the right, determining the maximum delivery position of valve plate 43. The portion of actuator 61 that is received within intake side bore 51 does not form a seal or piston, rather clearances exist which communicate with intake chamber 29. Furthermore, an additional passage (not shown) communicates intake chamber 29 to intake pressure bore 51 and thus to the recess which contains intake spring 63.

The left or control side end of actuator 61 contains a seal 67 which sealingly engages control pressure bore 53. Control pressure bore 53 communicates with control pressure as subsequently described, which applies pressure between seal 67 and end cap 57. A control side spring 69 and a cylindrical spacer 68, which may be considered a part of spring 69, are located within a recess 70 formed in actuator 61. Control side spring 69 and spacer 68 are fully contained within the recess 70, with the outer end of spacer 68 terminating a selected distance from the left-hand end of actuator 61. A stop 71 is rigidly secured to end cap 57 and protrudes toward end cap 55 for contact with spacer 68 within recess 70.

Stop 71, spacer 68 and spring 69 have lengths selected such that spacer 68 will contact stop 71 only when actuator 61 has moved to a selected intermediate or equilibrium point between the minimum delivery position on the left and the maximum delivery position on the right. When the compressor is not operating, intake side spring 63 will push actuator 61 to a point wherein control side spring 69 brings stop 71 into contact with spacer 68, and an opposing force balance between springs 63 and 69. The equilibrium point is selected to be between 10–20% of the maximum delivery position, preferably 15%. To move to the minimum delivery position from the equilibrium position requires further compression of control side spring 69.

Figure 5:
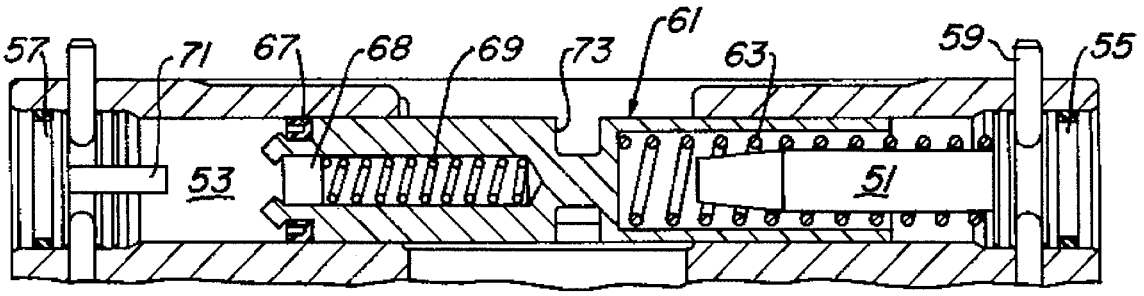
FIG. 5 is a sectional view similar to FIG. 2, but enlarged and shown with the actuator moved to another position.

In the preferred embodiment, control side spring 69 has a greater spring rate than intake side spring 63. In one embodiment, intake side spring 63 has a spring constant of 13.3 lbs per inch, while control side spring 69 has a spring rate of about 50 lbs per inch. In the embodiment shown, control side spring 69 has a much smaller diameter than intake side spring 63. FIG. 5 shows actuator 61 being moved closer toward the maximum delivery position from the position shown in FIG. 2.

Referring still to FIG. 2, a circumferential groove 73 extends completely around a mid-section portion of actuator 61. Groove 73 is perpendicular to the actuator member axis 74. Pin 49 engages groove 73, as shown by the dotted lines in FIG. 2 and by the solid lines in FIG. 1. The tip of pin 49 extends less than the distance from the base of groove 73 to the rearward face of valve plate 43.

Because the pin axis 50 is offset from the shaft axis 20, pin 49 will move in an arcuate path between the minimum delivery position and the maximum delivery position. Pin axis 50 is slightly offset below actuator axis 74 in the minimum and maximum positions. When in the intermediate position, pin axis 50 will be offset slightly above actuator axis 74. While moving from the minimum delivery to the maximum delivery position, pin axis 50 will at one point intersect actuator axis 74. As the pin 49 moves up and down relative to actuator 61, it will be engaging a side wall of groove 73. Actuator 61 is allowed to rotate about axis 74 relative to bores 51, 53. The engagement of the groove 73 with the pin 49 causes incremental rotation of actuator 61 as the pin 49 moves in its arcuate path. The rotation of actuator 61 reduces excessive wear in a single spot that may otherwise occur over a long period of operation.

Figure 3:
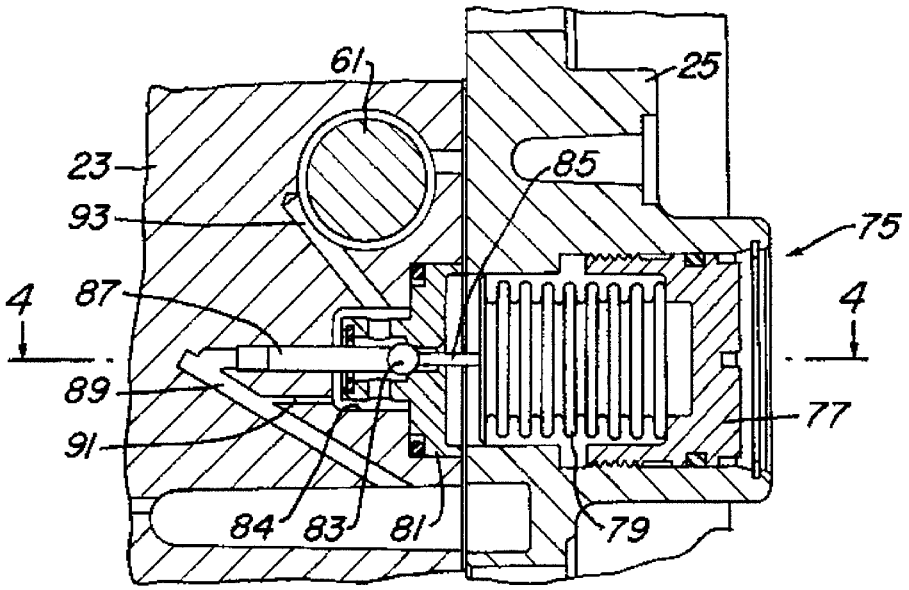
FIG. 3 is a partial sectional view of the compressor of FIG. 1, taken along the section line 3—3 of FIG. 2.
Figure 4:
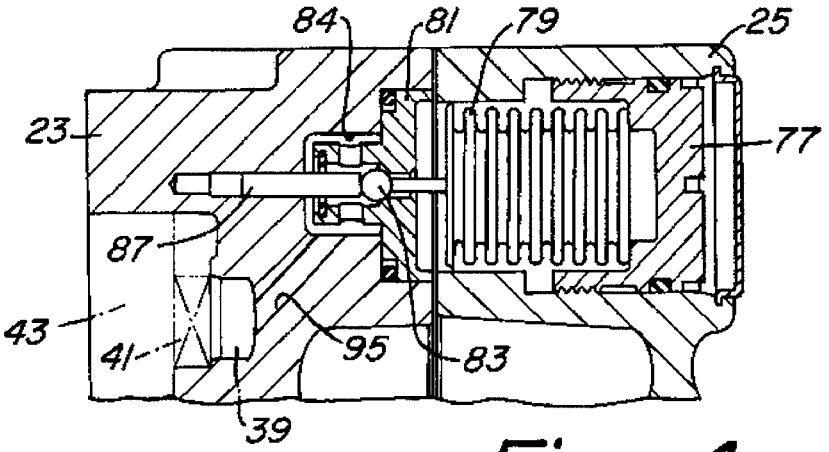
FIG. 4 is another partial sectional view of the compressor of FIG. 1, taken along the section line 4—4 of FIG. 3, and with a portion of the rear head shown in section.

FIGS. 3 and 4 illustrate a control valve 75 for controlling the movement of actuator 61. Control valve 75 is located partially within a cavity in valve housing 23 and also partially within a cavity in rear head 25. Control valve 75 includes an end cap 77, a bellows 79, and a valve seat member 81. Bellows 79 is carried within a portion of the cavity that is under intake pressure. Valve seat member 81 has a ball 83 that will engage a seat positioned between control pressure and intake pressure. A stem 85 will push ball 83 off of its seat to communicate intake pressure with control pressure chamber 84 under low intake pressure conditions. Under high intake pressure conditions, bellows 79 contracts, removing stem 85 from engagement with ball 83. The control pressure then rises to discharge pressure level.

Bias pin 87 acts against ball 83 in a direction opposite to stem 85. Bias pin 87 is subjected to discharge pressure from a discharge pressure passage 89. A metered orifice 91 allows a selected amount of discharge gas to flow to control pressure chamber 84. A control pressure passage 93 extends from control pressure chamber 84 to control pressure bore 53 (FIG. 2). As shown in FIG. 4, a control pressure passage 95 also extends to seal 39.

In operation prior to start up, spacer 68 (FIG. 2) will be in contact with stop 71, and control spring 69 will be partially compressed. Intake side spring 63 will be under compression, applying an opposing force to maintain spacer 68 and control side spring 69 in contact with stop 71. This will position valve plate 43 in an intermediate or equilibrium position. The equilibrium position opens the passages from intake chamber 29 to compression chamber 13 to a point of approximately 10–20% of what would exist at the maximum or full delivery position.

Rotor 17 will rotate, causing vanes 21 to compress refrigerant, which passes out valve 22 (FIG. 6). If the conditions are more demanding, such as at low speeds on hot days, then the intake pressure will be high. Referring to FIG. 3, stem 85 will allow ball 83 to remain on its seat. Discharge gas from discharge passages 89 will flow through metered orifice 91 and through control pressure passage 93 to the actuator 61. The higher pressure forces actuator 61 toward end cap 55, shown in FIG. 5. This moves pin 49, which in turn causes rotation of valve plate 43 to a higher capacity position.

If the conditions become less demanding, such as when the vehicle has reached a cool temperature and the compressor and vehicle are operating at a high speed, then the intake pressure will drop. Referring to FIG. 3, this causes bellows 79 to expand with stem 85 pushing ball 83 off of its seat. This communicates intake pressure with the control pressure chamber 84, dropping the control pressure. The drop in the control pressure causes the actuator 61 to move toward the end cap 57, as shown in FIG. 2. If the drop is significantly large, eventually the actuator 61 can move all the way to the left into contact with end cap 57, compressing control side spring 69. This movement of actuator 61 rotates valve plate 43 to a position of lower capacity.

The invention has significant advantages. The control side spring positions the actuator in an intermediate position at start up, rather than a minimum delivery position. This provides rapid start ups under all ambient conditions. The radial positioning of the thrust bearing pack allows the bearing to be assembled completely in the recess rather than being partially assembled on the valve plate. This facilitates assembly. The incremental rotation of the actuator by the pin engaging the groove reduces wear.

While the invention has been shown in only one of its forms, it should be apparent to those skilled in the art that it is not so limited, but is susceptible to various changes without departing from the scope of the invention.

I claim:

1. A rotary vane compressor comprising in combination:

a valve plate mounted adjacent to an intake opening of a compression chamber for rotation about a rotational axis to vary the intake opening to the compression chamber;

a bore formed in the compressor having a bore axis transverse to the valve plate, the bore having an intake pressure end exposed to intake pressure of the compressor and a control pressure end;

a control valve for supplying a variable control pressure to the control pressure end of the bore in response to varying intake and discharge pressures of the compressor;

a linearly movable actuator member located in the bore and pivotally connected to the valve plate for rotating the valve plate;

an intake side spring engaging the actuator member for urging the actuator member toward the control pressure end;

a control side spring engaging the actuator member for applying a force to urge the actuator member toward the intake pressure end; and wherein the control side spring applies the force to the actuator member only when the actuator member is within a selected distance from the control pressure end of the bore.

2. A rotary vane compressor, comprising in combination:

a valve plate mounted adjacent to an intake opening of a compression chamber for rotation about a rotational axis to vary the intake opening to the compression chamber;

a bore formed in the compressor having a bore axis transverse to the valve plate, the bore having an intake pressure end exposed to intake pressure of the compressor and a control pressure end;

a control valve for supplying a variable control pressure to the control pressure end of the bore in response to varying intake and discharge pressures of the compressor;

a linearly movable actuator member located in the bore and pivotally connected to the valve plate for rotating the valve plate;

an intake side spring engaging the actuator member for urging the actuator member toward the control pressure end;

a control side spring engaging the actuator member for applying a force to urge the actuator member toward the intake pressure end; and wherein the control side spring and intake side spring position the actuator member in an intermediate position between the intake pressure end and control pressure end when the compressor is off.

3. A rotary vane compressor, comprising in combination:

a valve plate mounted adjacent to an intake opening of a compression chamber for rotation about a rotational axis to vary the intake opening to the compression chamber;

a bore formed in the compressor having a bore axis transverse to the valve plate, the bore having an intake pressure end exposed to intake pressure of the compressor and a control pressure end;

a control valve for supplying a variable control pressure to the control pressure end of the bore in response to varying intake and discharge pressures of the compressor;

a linearly movable actuator member located in the bore and pivotally connected to the valve plate for rotating the valve plate;

an intake side spring engaging the actuator member for urging the actuator member toward the control pressure end;

a control side spring engaging the actuator member for applying a force to urge the actuator member toward the intake pressure end;

a spring stop member mounted to the control pressure end and protruding toward the intake pressure end;

a recess formed in the actuator member; and wherein the control side spring is located in the recess in a position so as to be stopped by the stop member when the actuator member is within a selected distance from the control pressure end.

4. A rotary vane compressor, comprising in combination:

a compression chamber having an intake opening;

a valve plate mounted adjacent to the intake opening for rotation about a rotational axis to vary the intake opening;

a bore formed in the compressor having a bore axis transverse to the rotational axis, the bore having an intake pressure end exposed to intake pressure of the compressor and a control pressure end;

a control valve for supplying a variable control pressure to the control pressure end in response to varying intake and discharge pressures of the compressor;

a linearly movable actuator member located in the bore and pivotally connected to the valve plate for rotating the valve plate; and spring means for positioning the actuator member in an intermediate position spaced from the intake pressure end and the control pressure end when the compressor is off, so that the valve plate will be in an intermediate position between minimum opening and maximum opening at start up.

5. The compressor according to claim 4, wherein the intermediate position is in the range from 10 to 20 percent of maximum opening.

6. The compressor according to claim 4, wherein the spring means comprises:

an intake side spring in engagement with the actuator member for urging the actuator member toward the control pressure end; and a control side spring in engagement with the actuator member for applying a force to urge the actuator member toward the intake pressure end.

7. The compressor according to claim 4 wherein the spring means comprises:

an intake side spring located in the bore for urging the actuator member toward the control pressure end;

a recess formed in the actuator member;

a control side spring located in the recess for applying a force to urge the actuator member toward the intake pressure end;

a spacer member slidably carried in the recess on an outer end of the control side spring; and a spring stop member mounted to the control pressure end and protruding toward the intake pressure end for contacting the spacer member to stop movement of the spacer member with the actuator member toward the control pressure end, but only when the actuator member is within a selected distance from the control pressure end.

8. In a rotary vane compressor having a valve plate mounted adjacent to an intake opening of a compression chamber for rotation about a rotational axis to vary the intake opening to the compression chamber, a bore formed in the compressor having a bore axis transverse to the rotational axis, the bore having an intake pressure end exposed to intake pressure of the compressor and a control pressure end, a control valve for supplying a variable control pressure to the control pressure end in response to varying intake and discharge pressures of the compressor, a linearly movable actuator member located in the bore and pivotally connected to the valve plate for rotating the valve plate, and an intake side spring located in the bore for urging the actuator member toward the control pressure end, the improvement comprising:

a control side spring;

mounting means for mounting the control side spring in the bore for applying a force to urge the actuator member toward the intake pressure end only when the actuator member is within a selected distance from the control pressure end; and wherein the control side spring and intake side spring position the actuator member in an intermediate position between the intake pressure end and control pressure end when the compressor is off, so as to place the valve plate in an intermediate position between minimum opening and maximum opening at start up.

9. The compressor according to claim 8 further comprising:

a spring stop member mounted to the control pressure end and protruding toward the intake pressure end;

a recess formed in the actuator member; and wherein the control side spring is located in the recess in a position so as to come into contact with the stop member only when the actuator member is within a selected distance from the control pressure end.

10. The compressor according to claim 8 wherein the control side spring has a greater spring force constant than the intake side spring.

11. In a rotary vane compressor having a valve plate located between a support face in a valve housing and a compression housing shoulder to vary the intake opening to the compression chamber, the improvement comprising:

an annular recess in the valve housing surrounding the support face, the annular recess having a base and an inner cylindrical wall which extends to the support face;

a seal located within the annular recess;

an annular bearing pack located within the recess, having a seal side thrust washer in contact with the seal and a valve plate side thrust washer in engagement with the valve plate, the bearing pack having inner diameters that are in contact with the cylindrical wall;

an actuator in engagement with the valve plate; and control valve means for supplying a variable control pressure to the actuator for rotating the valve plate and for supplying a variable control pressure to the base of the annular recess for applying a force through the seal and the bearing to the valve plate in response to varying intake and discharge pressures of the compressor.

12. The compressor according to claim 11, wherein:

the valve housing has a circular boss which is surrounded by and protrudes from the support face; and the support face extends between the boss and the cylindrical wall of the recess and is located in a single plane.

13. The compressor according to claim 11 wherein:

the valve housing has a circular boss which is surrounded by and protrudes from the support face;

the support face extends between the boss and the cylindrical wall of the recess and is located in a single plane; and the valve plate has a counterbore which slidingly receives the boss and a flat surface extending radially outward therefrom in a single plane to an outer diameter of the bearing.

14. A rotary vane compressor, comprising in combination:

a compression chamber having an intake opening;

a valve plate mounted adjacent to the intake opening for rotation between minimum and maximum delivery positions about a rotational axis;

an actuator member mounted in the compressor for linear movement along an actuator member axis which is perpendicular to the rotational axis, the actuator member being rotatable about the actuator member axis, the actuator member having a cylindrical midsection containing a circumferential groove that is perpendicular to the actuator member axis;

a pin mounted to and extending normal from the plate away from the compression chamber into the groove;

control valve means for supplying a variable control pressure to move the actuator member for rotating the valve plate through engagement of the pin and groove; and the pin being offset from the rotational axis so that movement of the valve plate between minimum and maximum delivery positions causes the pin to move along an arcuate path, the engagement of the groove with the arcuately moving pin forcing the actuator member to incrementally rotate about the actuator member axis.

15. The compressor according to claim 14 wherein:

the actuator member groove has an inner diameter spaced a selected distance from the valve plate; and the pin has a length less than the selected distance.

16. The compressor according to claim 14 wherein:

the pin has a pin axis which is offset in a first direction from the actuator member axis while in the minimum and maximum delivery positions, and which intersects the actuator member axis and moves to a position offset in a second direction from the actuator member axis while moving between the minimum and maximum delivery positions.

* * * * *